US005553440A

United States Patent [19]

Bulger et al.

[11] Patent Number: 5,553,440

[45] Date of Patent: Sep. 10, 1996

[54] MULTI-SHEET GLAZING UNIT AND METHOD OF MAKING SAME

[75] Inventors: Mark L. Bulger, McCandless Township, Allegheny County; Albert E. Thompson, Jr., Allegheny Township, Westmoreland County, both of Pa.

[73] Assignee: PPG Industries, Inc., Pittsburgh, Pa.

[21] Appl. No.: 326,565

[22] Filed: Oct. 20, 1994

[51] Int. Cl.[6] ..... E04C 2/54

[52] U.S. Cl. ..... 52/786.13; 52/172; 52/308; 52/800.14; 52/786.1; 52/786.11; 52/741.1

[58] Field of Search ..... 52/786.1, 786.11, 52/786.13, 172, 308, 800.14, 741.1

[56] References Cited

U.S. PATENT DOCUMENTS

| | | | |
|---|---|---|---|
| 2,525,717 | 10/1950 | Ottenheimer . | |
| 2,575,854 | 11/1951 | Verhagen . | |
| 2,688,824 | 9/1954 | Badger et al. | 52/786.1 X |
| 2,861,398 | 11/1958 | Woods | 52/786.1 X |
| 2,877,516 | 3/1959 | Bobel . | |
| 3,024,880 | 3/1962 | Burmeister | 52/786.1 X |
| 3,045,297 | 7/1962 | Ljungdahl . | |
| 3,837,129 | 9/1974 | Losell . | |
| 3,919,023 | 11/1975 | Bowser et al. . | |
| 3,919,821 | 11/1975 | Goetz | 52/786.13 X |
| 4,149,348 | 4/1979 | Pyzewski . | |
| 4,170,460 | 10/1979 | Donley . | |
| 4,239,816 | 12/1980 | Breininger et al. . | |
| 4,335,166 | 6/1982 | Lizardo et al. . | |
| 4,368,226 | 1/1983 | Mucaria | 52/786.11 X |
| 4,411,115 | 10/1983 | Marzovki et al. | 52/786.13 X |
| 4,610,711 | 9/1986 | Matesa et al. . | |
| 4,719,127 | 1/1988 | Greenberg . | |
| 4,792,536 | 12/1988 | Pecoraro et al. . | |
| 4,806,220 | 2/1989 | Finley . | |
| 4,853,256 | 8/1989 | Obringer et al. . | |
| 4,853,257 | 8/1989 | Henery . | |
| 5,007,217 | 4/1991 | Glover et al. | 52/786.13 X |
| 5,030,593 | 7/1991 | Heithoff . | |
| 5,240,886 | 8/1993 | Gulotta et al. . | |
| 5,313,762 | 5/1994 | Guillemet . | |

*Primary Examiner*—Wynn E. Wood
*Assistant Examiner*—Aimee E. McTigue
*Attorney, Agent, or Firm*—Donald C. Lepiane

[57] ABSTRACT

A multi-sheet glazing unit has a pair of outer glass sheets spaced from one another and secured to a spacer frame having a generally U-shaped cross section defined by outer legs secured to a base. The recess of a sheet retaining member is mounted on peripheral edge portions of an intermediate glass sheet. The intermediate glass sheet and sheet retaining member are mounted within the outer legs of the spacer frame to position the intermediate sheet between and spaced from the outer sheets. A method of making multi-sheet units is also disclosed.

27 Claims, 2 Drawing Sheets

MULTI-SHEET GLAZING UNIT AND METHOD OF MAKING SAME

FIELD OF THE INVENTION

This invention relates to a multi-sheet glazing unit having a pair of outer sheets e.g. glass sheets separated and secured to a spacer frame and intermediate sheet(s) e.g. glass sheet(s) secured in position within the spacer frame between the outer sheets and, in particular, to a sheet retaining member mounted on the peripheral edge portions and extending over marginal edge portions of the intermediate glass sheet(s) and positioned within the spacer frame to maintain the intermediate glass sheet(s) between and spaced from the outer glass sheets, and to a method of making a multi-sheet glazing unit.

BACKGROUND OF THE INVENTION

European Patent Application Publication Number 0 475 213 A1 published 18.03.92 Bulletin 92/12 (hereinafter "EP Application") based on U.S. patent applications Ser. Nos. 578,697 filed Sep. 4, 1990; 578,696 filed Sep. 4, 1990, and 686,956 filed Apr. 18, 1991, discloses thermal insulating glazing units having an edge assembly having low thermal conductivity and a method of making same. In general, the EP Application teaches thermal insulating glazing units having a pair of glass sheets about and sealed to an edge assembly to provide a sealed compartment between the sheets. The edge assembly includes a U-shaped spacer frame made of a material that is moisture and/or gas impervious, the spacer frame having a sealant on each of the outer surfaces of the upright legs of the spacer frame and a moisture pervious adhesive bead having desiccant therein adhered to inner surface of the spacer frame. The materials of the edge assembly are selected and sized to provide the edge assembly with a predetermined RES-value as defined and determined in accordance to the EP Application. The EP Application further discloses a thermal insulating glazing unit having three or more sheets with an edge assembly between the adjacent glass sheets.

U.S. patent application Ser. No. 08/102,596 filed Aug. 5, 1993, (hereinafter "U.S. patent application Ser. No. 08/102,596") discloses multi-sheet glazing units or thermal insulating units having one or more glass sheets spaced from and between a pair of outer glass sheets. In general, the units include the pair of outer glass sheets secured to outer legs of a spacer frame having a U-shaped cross section. On the base of the U-shaped spacer frame between the upright legs is a layer of a pliable material having a groove(s) for receiving edge portions of intermediate glass sheet(s).

Although the units disclosed in the EP Application and U.S. patent application Ser. No. 08/102,596 are acceptable, it would be beneficial to have a method of manufacturing a multi-sheet glazing unit having three or more sheets that doesn't require providing an edge assembly between adjacent sheets as disclosed in the EP application or forming a groove(s) in a layer of pliable material to receive the edge of the intermediate sheet(s) as disclosed in U.S. patent application Ser. No. 08/102,596.

U.S. Pat. No. 4,149,348 discloses multi-sheet glazing units having three or more glass sheets. In general, the units include a pair of outer glass sheets separated by a spacer-dehydrator element, or metal spacer having a generally rectangular cross sectional configuration and having a groove to maintain the intermediate glass sheet(s) between and spaced from the pair of outer glass sheets.

Although the glazing units taught in U.S. Pat. No. 4,149,348 are acceptable, there are limitations. More particularly, the spacer-dehydrator element containing desiccant is formed with a groove, and thereafter the spacer-dehydrator element has to be stored in a dry environment to prevent adsorption of moisture by the desiccant prior to its use. The use of the grooved metal spacer requires additional steps to form the spacer thereby increasing the fabrication cost of the glazing unit.

As can be appreciated, it would be advantageous to provide multi-sheet glazing units having three or more sheets and method of making multi-sheet glazing units that supplement and/or minimize or eliminate the limitations of presently known multi-sheet glazing units and methods of making them.

SUMMARY OF THE INVENTION

This invention relates to multi-sheet glazing units having three or more sheets. The multi-sheet units include a spacer frame positioned between and secured to a pair of outer sheets e.g. by an adhesive-sealant. The spacer frame has a base having a first surface and an opposite second surface with the second surface facing the interior of the spacer frame and having opposed sides to which the outer sheets e.g. glass sheets are secured. A sheet retaining member having a recess to receive peripheral edge portions and extending over marginal edge portions of an intermediate sheet or third sheet is positioned over the second surface of the base of the spacer frame to position the third sheet within the spacer frame spaced from the outer sheets.

The invention also relates to a method of making multi-sheet glazing units. The method includes the step of providing a sheet retaining member having a recess mounted on selected surface portions of a section of spacer stock. Peripheral edge portions of a sheet e.g. the third glass sheet are positioned in the recess while the spacer stock is positioned around the intermediate sheet and sheet retaining member to form a spacer frame having the intermediate sheet and sheet retaining member positioned therein. An outer sheet is secured to each side of the spacer frame to provide the multi-sheet glazing unit.

DESCRIPTION OF THE INVENTION

The various embodiments of the multi-sheet glazing unit of the instant invention will be discussed in the construction of a multi-sheet glazing unit that is a thermal insulating glazing unit having a low thermal conducting edge, e.g. determined as disclosed in the EP Application which disclosure is hereby incorporated by reference. As will be appreciated, the instant invention is not limited to a multi-sheet glazing unit that is thermally insulating and/or has a low thermal conductivity edge, and that the embodiments of the present invention may be used with a multi-sheet glazing unit regardless of its thermal insulating value. In the following discussion unless otherwise indicated like numerals refer to like elements.

Figure 1:
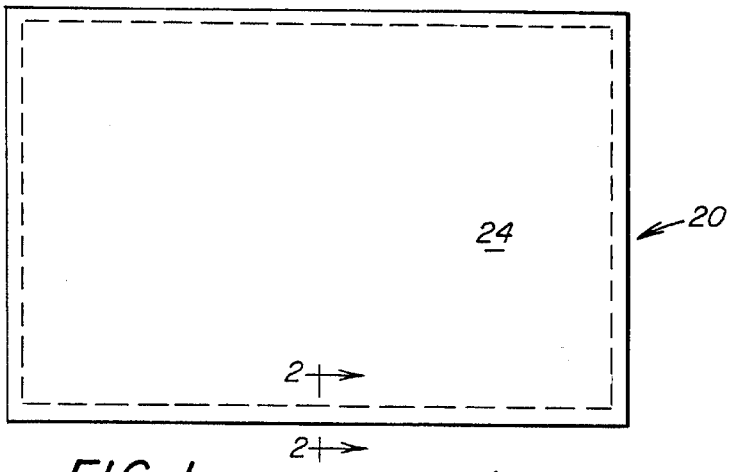
FIG. 1 is a front elevated view of a multi-sheet glazing unit incorporating features of the invention.
Figure 2:
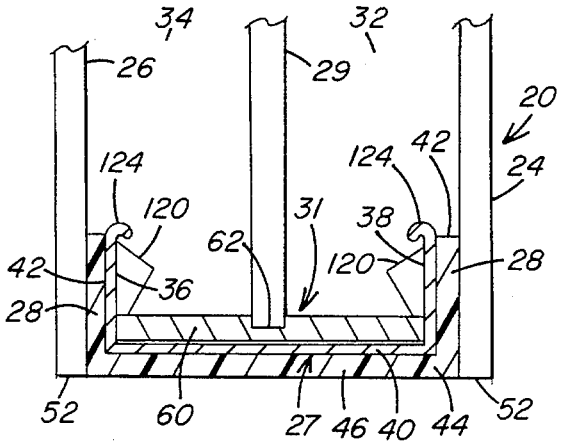
FIG. 2 is the view taken along lines 2—2 of FIG. 1 illustrating a spacer frame to space the outer sheets and having an embodiment of the sheet retaining member of the invention to retain the intermediate sheet in position between the outer sheets.

FIG. 1 shows a multi-sheet glazing unit 20, and FIG. 2 shows a cross-sectional view of the multi-sheet unit 20 incorporating features of the invention. With specific reference to FIG. 2, the unit 20 has a pair of outer sheets 24 and 26 secured to a spacer frame 27 by layer 28 of a sealant, and an intermediate sheet 29 held in position between the outer sheets by sheet retaining member 31 incorporating features of the invention to provide a compartment 32 between the sheets 24 and 29 and a compartment 34 between the sheets 26 and 29. Preferably but not limiting to the invention, the compartments 32 and 34 are sealed against the egress and ingress of gas e.g. air, moisture and/or or dust (hereinafter individually and collectively referred to as "environmental air") in a manner to be discussed below.

In the following discussion the sheets 24, 26 and 29 are glass sheets; however, as will become apparent, the sheets may be made of any material e.g. glass, plastic, metal and/or wood, and the selection of the material is not limiting to the invention. Further, the sheets may be all of the same material s or the sheets may be of different material, and one sheet may be a monolithic sheet and the other(s) a laminated sheet e.g. made of one or more monolithic sheets laminated together in any convenient manner. Still further, one or more of the surfaces of one or more sheets may be coated e.g. glass or plastic transparent sheets may have an opaque coating of the type used in making spandrels or, an environmental coating to selectively pass predetermined wavelength ranges of light. U.S. Pat. Nos. 4,610,711; 4,806,220; 4,853,257; 4,170,460; 4,239,816 and 4,719,127 hereby incorporated by reference disclose coated sheets that may be used in the practice of the invention; however, as can now be appreciated, the instant invention is not limited thereto. One or more of the glass sheets may be coated and/or uncoated colored sheets, for example but not limiting to the invention, colored sheets of the type disclosed in U.S. Pat. Nos. 4,873,206; 4,792,536; 5,030,593 and 5,240,886 which teachings are hereby incorporated by reference may be used in the practice of the invention.

The outer glass sheets 24 and 26 preferably have the same peripheral configuration and dimensions; however, as can be appreciated, one outer glass sheet may be larger than the other outer glass sheet, and one or more of the sheets 24, 26 and 29 may have different peripheral configurations than the remaining sheet(s).

With continued reference to FIG. 2, the spacer frame 27 has a generally U-shaped cross section defined by a pair of is spaced outer legs 36 and 38 secured to a base 40. The sealant layer 28 is preferably a moisture impervious material e.g. an adhesive-sealant material of the type used in the art of making double glazed units having sealed compartments between outer sheets. The layer 28 is provided on outer surfaces 42 of outer legs 36 and 38 of the spacer frame 27 as mentioned above to secure the outer sheets 24 and 26 to outer legs 36 and 38 respectively of the spacer frame 28 to seal the compartments 32 and 34 against movement of environmental air into and out of the compartments.

With specific reference to FIG. 2, a layer 44 of an adhesive, sealant or adhesive-sealant may be provided over outer surface 46 of the base 40 of the spacer frame 27. The layer 44 may be a material similar to the material of the layer 28. It is preferred that the material of the layer 44 be non-tacky so that the multi-sheet units when stored or shipped on edge do not stick to the supporting surface. Further, in the practice of the invention, multi-sheet units having the layer 44, preferably have the spacer frame 27 above the peripheral edges 52 of the outer sheets 24 and 26 as viewed in FIG. 2 to provide a channel to receive the layer 44. The thickness of the layer 44 is not limiting to the invention, and the layer 44 may have a thickness of about 0.031 inch (0.08 cm) to about 0.50 inch (1.27 cm); preferably a thickness of about 0.150 inch (0.38 cm). The layer 44 preferably has similar moisture and gas resistance values as the layers 28. As can now be appreciated and with reference to FIG. 3, the instant invention contemplates multi-sheet units without the layer 44 as shown for multi-sheet unit 50 in FIG. 3. The outer surface 46 of the base 40 of the spacer frame 27 for the unit 50 shown in FIG. 3 is generally aligned with the peripheral edges 52 of the outer sheets 24 and 26.

The spacer frame 27 may be made of any material e.g. wood, plastic, metal e.g. stainless steel, galvanized iron or tin coated steel, or aluminum and preferably is U-shaped to retain the sheet retaining member 31 of the instant invention secured in position. As can be appreciated, the invention is not limited to a U-shape and the spacer frame may have any cross-sectional configuration e.g. W-shape. Further, although not limiting to the invention the spacer frame is a closed spacer frame. The term closed spacer frame as used herein means that the spacer frame has no separation after the spacer frame is formed e.g. the spacer frame around the periphery is continuous with no separations or gaps.

Figure 4:
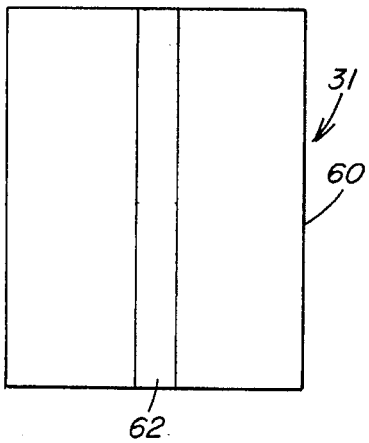
FIG. 4 is a plan view of the sheet retaining member of the instant invention shown in FIG. 2.

The discussion will now be directed to the sheet retaining member 31 of the instant invention. With reference to FIGS. 2 and 4 the member 31 has a base 60 having a recess 62 to receive the peripheral edge portions of the intermediate glass sheet(s) 29 and extend over marginal edge portions of the intermediate sheet 29 as shown in FIG. 2 to limit movement of the intermediate sheet toward the outer sheets 24 and 26, and in the instance of more than one intermediate sheet, movement of the intermediate sheets 29 toward and away from one another. The depth of the recess 62 is not limiting to the invention. Preferably in the practice of the invention the recess has a depth of about 1/32 inch (0.08 cm) to about 1/8 inch (0.32 cm).

Figure 3:
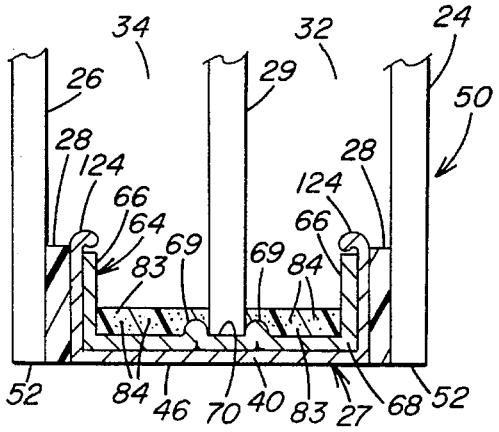
FIG. 3 is a view similar to the view in FIG. 2 illustrating another embodiment of the sheet retaining member of the instant invention.

FIG. 3 shows sheet retaining member 64 of the instant invention. The member 64 has a generally U-shaped cross sectional configuration defined by outer upright legs 66 joined to a base 68; the base 68 having raised portions 69 to provide a recess 70 to receive the peripheral edges of the intermediate sheet 29 and extend over marginal edge portions of the intermediate sheet 29 as shown in FIG. 3. The raised portions forming the recess may be continuous or may be raised discreet portions. For example and with reference to FIG. 5, there is shown an additional embodiment of the sheet retaining member of the invention. Sheet retaining member 72 shown in FIG. 5 has a base 74 having spaced discreet offset elevated dimpled or raised portions 76 and 77. The raised portions 76 are spaced along a predetermined path e.g. a first predetermined path shown as dotted line 78, and the raised portions 77 are spaced along a predetermined path e.g. a second predetermined path shown as dotted line 79 spaced from the first predetermined path to form a retaining groove 80 to receive peripheral edge portions of the intermediate sheet 29 and with the raised portions 76 and 77 engaging marginal edge portions of the intermediate sheet 29.

Figure 5:
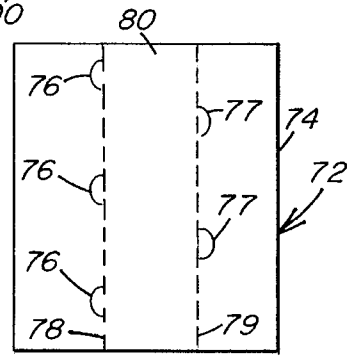
FIG. 5 is a plan view illustrating another embodiment of the sheet retaining member of the invention.

As can now be appreciated, the raised portions 76 and 77 may be made in any manner e.g. by molding, forming, swedging or securing material to the base of the spacer e.g. applying molten material or adhesive that solidifies and adheres to a substrate to form the raised portions. As can now further be appreciated, the raised portions 76 and 77 may be aligned with one another or offset as shown in FIG. 5.

Figure 6:
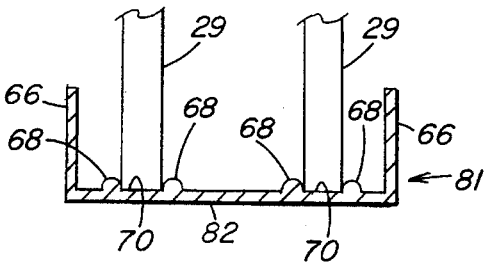
FIG. 6 is a cross sectional view illustrating another embodiment of the sheet retaining member of the invention to retain and space more than one intermediate sheet.

The invention is not limited to the number of intermediate sheets 29 in the multi-sheet glazing unit. For example and with reference to FIG. 6 there is shown sheet retaining member 81 similar to the sheet retaining member 64 shown in FIG. 3, but having a pair of recesses 70 formed on base 82 instead of one recess 70 shown for the retaining member 64 in FIG. 3. Each pair of the recesses 70 receive peripheral edge portions of an intermediate sheet 29 and extend over marginal edge portions of the intermediate sheet 29.

The sheet retaining member of the instant invention may be made of any material e.g. metal, non-metal, plastic, wood or plastic reinforced with fiber glass. When the multi-sheet unit is designed to have a low thermal conducting edge, the sheet retaining member is preferably made of a low thermal conducting material such as wood, plastic, stainless steel, galvanized steel or tin plated steel.

With reference to FIG. 3, a bead 83 of a moisture pervious material having a desiccant 84 to keep the compartments 32 and 34 dry may be provided on the sheet retaining member e.g. the sheet retaining member 64 shown in FIG. 3. The bead 83 may be made of any moisture pervious material. Although the invention is not limited thereto, moisture pervious materials having a permeability greater than about 2 gm mm/$M^2$ day as determined by the procedure set out in ASTM F 372-73 are recommended in the practice of the invention. Such materials are disclosed in the EP Application and U.S. patent application Ser. No. 08/102,546.

The recesses 62 (FIGS. 2 and 4), 70 (FIGS. 3 and 6) and 80 (FIG. 4) hold the intermediate sheet(s) in position; therefore, the bead 83 does not need to have structural stability. The material of the bead 83 may be of the type known in the art of insulated glazing units. Using a flowable material provides for ease of automating the fabrication of units incorporating features of the invention. Materials that may be used are of the type taught in the EP Application, and materials that are flowable and harden e.g. are dimensionally stable after flowing e.g. of the type taught in U.S. patent application Ser. No. 08/102,596.

The spacer frames used in the practice of the instant invention may be formed to have continuous corners e.g. of the type disclosed in the EPA Publication, or may be formed by joining ends of spacer sections by corner keys or welding as is known in the art of making insulating glazing units.

Although the spacer frames may be made of any material, it is preferred that the spacer frame used in the practice of the instant invention have low thermal conductivity so that the spacer frame, the layers 28 of adhesive-sealant and the layer 44, if present collectively define an edge assembly that separates the outer sheets 24 and 26, and has a low thermal conductivity or high RES-value.

As can be appreciated, the spacer frame used in the practice of the instant invention should also be made of a material that is moisture and/or gas impervious such as but not limited to metal e.g. stainless steel, but includes halogenated polymeric material and/or spacers made of a gas pervious material and covered with an impervious film e.g. metal or polyvinylidene chloride film.

In regards to the edge assembly having a low thermal conductivity, spacer frames made of aluminum conduct heat better than spacer frames made of metal coated steels e.g. galvanized or tin plated steel, spacer frames made of metal coated carbon steels conduct heat better than spacer frames made of stainless steels, and spacer frames made of stainless steels conduct heat better than spacer frames made of plastics. Plastic provides better spacer frames from the standpoint of low thermal conductivity; however, metal is preferred for spacer frames because, among other things, it is easier to shape and lends itself more easily to automation than plastic. The above discussion is applicable to material selection for the sheet retaining member of the instant invention; however, in the practice of the invention, the sheet retaining member is made of plastic.

The EP Application discusses in detail the concept of edge assemblies having low thermal conductivity and how RES-value is determined and reference may be made thereto for a detailed discussion. As mentioned in the EP Application, computer programs are available which solve the exact relations governing heat flow or resistance to heat flow through the edge of the unit and may be used to determine the thermal conductivity at the edge of the unit. One computer program that is available is the thermal analysis package of the ANSYS program available from Swanson Analysis Systems Inc. of Houston, Pa.

Although not limiting to the invention it is preferred that the layer 28 of the adhesive sealant that secures the outer sheets to the spacer frame 27 provides a long path to resist the movement of environmental air into and out of the compartment. Although the invention is not limited to the spacer frame design, it is preferred in the practice of the invention to use a spacer frame having a U-shaped cross section e.g. of the type shown in FIGS. 2 and 3 to secure the sheet retaining member of the instant invention in position and to provide a long forming path. As used herein the forming path is defined by the outer legs of the spacer frame and the marginal edge portions of the outer sheets.

It can now be appreciated that the materials of the layer 28 and the layer 44 are not limiting to the invention and are preferably a material that is gas and/or moisture impervious to prevent the ingress of environmental air into the compartment between the sheets. Materials that may be used in the practice of the invention include, but are limited to, butyl hot melts of the type sold by H. B. Fuller e.g. H. B. Fuller 1191. Units filled with an insulating gas e.g. Argon preferably have the adhesive-sealant layer 28 and the layer 44 of a moisture and/or gas impervious material to maintain the insulating gas in the compartments 32 and 34.

It is recommended that the adhesive sealant layer 28 be thin and long to reduce the diffusion of the insulating gas out of the compartments of the unit or the environmental gas moving into the compartments of the unit. More particularly, increasing the thickness of the layer 28 i.e. the distance between the glass sheet and the adjacent outer leg of the spacer frame while keeping all other conditions constant increases the diffusion rate, and increasing the length of the layer 28 i.e. the distance between the top of the outer leg of the spacer frame and the base of the spacer frame while keeping all other conditions constant decreases the diffusion rate of gas through the adhesive-sealant layer 28. The invention may be practiced with the adhesive-sealant layer 28 having a thickness of about 0.005 inch (0.013 cm) to about 0.125 inch (0.32 cm), preferably about 0.010 inch (0.025 cm) to about 0.020 inch (0.050 cm) and more preferably about 0.015 inch (0.38 cm), and the layer 28 having a length of about 0.010 inch (0.025 cm) to about 0.50 inch (1.27 cm), preferably about 0.125 inch (0.32 cm) to about 0.50 inch (1.27 cm) and more preferably about 0.200 inch (0.50 cm).

Adhesive-sealants that may be used in the practice of the invention include but are not limited to butyls, silicones, polyurethane adhesives, and preferably are butyls and polyurethanes such as H. B. Fuller 1191, H. B. Fuller 1081A and PPG Industries, Inc. 4442 butyl sealant.

With respect to the loss of the fill gas e.g. an insulating gas such as Argon from the unit, in practice the thickness and length of the layer 28 are chosen in combination with the gas permeability of the material so that the rate of loss of the fill gas matches the desired unit performance lifetime. The ability of the unit to contain the fill gas is measured using a European procedure identified as DIN 52293. Preferably, the rate of loss of the fill gas should be less than about 5% per year and, more preferably, it should be less than about 1% per year.

The material for the layer 28 preferably has a moisture permeability of less than about 20 gm mm/$M^2$ day, and more preferably less than about 5 gm mm/$M^2$ day, determined using the procedure of ASTM F 372-73.

As can now be appreciated, the sheet retaining member of the instant invention may be used with any spacer frame provided the sheet retaining member is retained in position. Although the sheet retaining member may be used with any type of spacer, it is preferred to use a spacer frame having a U-shaped cross section because the outer walls of the spacer frame aid in securing the sheet retaining member in position. A U-shaped spacer frame may be made by joining spacer sections having a U-shaped cross section together. However, it is preferred to use a U-shaped spacer frame having continuous corners of the type disclosed in the EP Application and in U.S. patent application Ser. No. 08/102,596.

The invention will be discussed to make a glazing unit similar to the unit 20 shown in FIGS. 1 and 2 having a closed spacer frame having continuous corners. Each of the outer sheets 24 and 26 are clear glass sheets having a length of about 42-⅞ inches (108.9 centimeter, hereinafter "cm") and a width of about 19-¾ inches (50.17 cm). The intermediate sheet 29 is a clear glass sheet having a length of about 42-⅜ inches (108.20 cm) and a width of about 19-¼ inches (48.90 cm). All the sheets have a thickness of 0.090 inch (0.229 centimeter).

The glass sheets 24 and 26 are each coated and are of the type sold by PPG Industries under its registered trademark Sungate® 100 coated glass. The coated surface of each of the sheets 24 and 26 faces the intermediate sheet 29.

Figure 7:
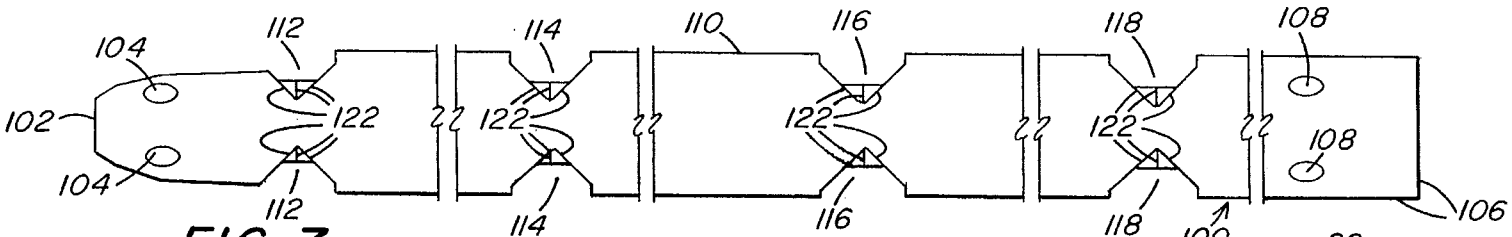
FIG. 7 is a plan view of a strip prior to shaping the strip into a spacer stock having the U-shaped cross sectional configuration shown in FIG. 2.

A spacer frame having four continuous corners is made as follows. A flat tin coated steel strip 100 having a length of about 126 inches (320 cm), a width of about 1.50 inches (3.81 cm) and thickness of about 0.010 inch (0.25 mm) is die cut. After die cutting the strip 100 as shown in FIG. 7 has a tapered and wedged end 102 having a pair of holes 104. Opposite end 106 of the strip 100 has a pair of holes 108 and receives the end 102 when the spacer frame is positioned around the intermediate sheet 29 to form a closed frame. Spaced at locations about 1.5 inches (3.8 cm), about 21-⅛ inches (53.65 cm), about 63-⅞ inches (162.24 cm), and about 83-½ inches (212.09 cm) from the end 102, material is removed from opposite edge portions 110 of the substrate 100 to provide sets of paired notches 112, 114, 116 and 118 respectively. The notched areas form the bent portions 120 (see only in FIG. 2), and the notches provide for the bent portions 120 to be a sufficient distance so as to receive the intermediate sheet 29 in the recess 62. Crease lines 122 are provided at the notches as shown in FIG. 7 for ease of bending subsequently formed spacer stock to form the continuous corners.

Each of the notches of the set of paired notches 114, 116 and 118 have a length of about 0.536 inch (1.36 cm) at the edge 110 of the substrate, a depth of about 0.170 inch (0.43 cm) as measured from the edge 110 of the substrate toward the center of the substrate. The notches 112 are similar in size as the notches 114, 116 and 118 but the left side of the notch as shown in FIG. 7 is further cut to insert the end 102 into the end 106 after the strip 100 is formed into the spacer stock having a U-shaped cross section. The distance between the points of pairs of notches depends on the width of the base of the spacer frame i.e. the desired spacing between the outer sheets. The unit has the point of the crease lines spaced about 0.500 inch (1.27 cm) from the edge 110 of the substrate to provide the base with a width of about 0.50 inch (1.27 cm).

The strip is shaped to provide a spacer stock having a U-shaped cross section as shown in FIG. 2. Ends 124 of the outer legs 36 and 38 are bent over to provide structure stability. Four sheet retainer members 60 formed of plastic are provided. Each sheet retaining member 60 has a base 60 having a width of 0.50 inch (1.27 centimeters) and a thickness of about ¼ inch (0.64 centimeter). The recess 62 has a width of 0.100 inch (0.254 centimeter) and a depth of ⅛ inch (0.32 centimeter). One of the sheet retaining members has a length of about 41-⅛ inch (104.46 cm), one of the sheet retaining members (the one positioned pair of notches 118 and the end 106) has a length of about 39-⅝ inches (100.65 cm), and the other two have a length of about 19-⅝ inches (49.85 cm). The sheet retaining member 31 may be positioned in the spacer stock as it is being formed, after it is formed, during the forming of the spacer frame or after the spacer frame is formed. Preferably the sheet retaining member is positioned during the shaping of U-shaped spacer stock 130 (fragmented view shown in FIG. 8) from the flat metal strip 100.

Figure 8:
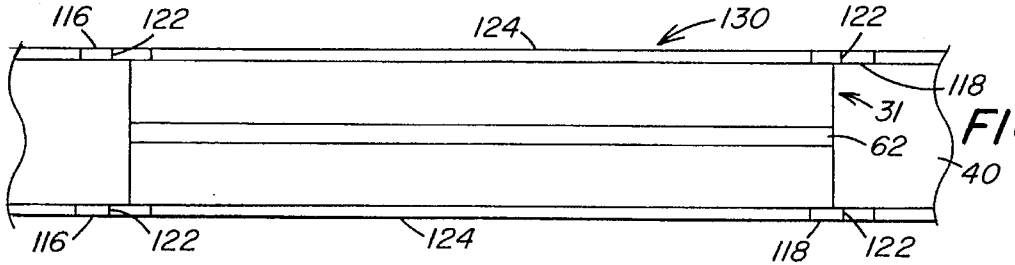
FIGS. 8–10 are fragmented plan view of the strip shown in FIG. 7 after being formed into spacer stock having a U-shaped cross sectional configuration and having embodiments of the sheet retainer member of the instant invention mounted within the spacer stock.
Figure 9:
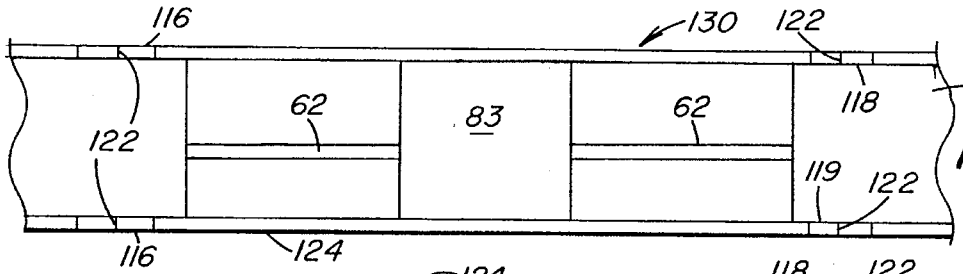
Figure 10:
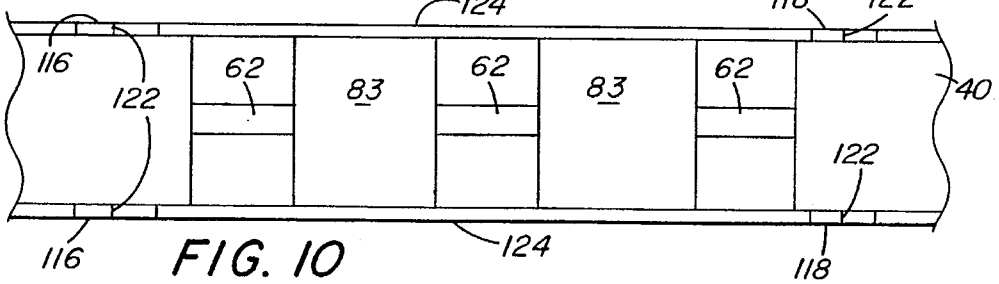

The sheet retaining member 31 may have a length sufficient to extend the full length of each side of the spacer frame e.g. extend the full length of the spacer frame between corners or may be shorter than the length of the side as shown in FIG. 8. It is preferred that if only one sheet retaining member is used it have a length less than the distance between the corners of the spacer frame but more than ⅔ the distance between the corners. If the sheet retaining member 31 has a length less than ⅔ the length between the corners of the spacer frame, it is recommended that two or more retaining members be used as shown in FIGS. 9 and 10. The length of the retaining members is preferably at least 3 inches in length and placed to balance the intermediate sheet to prevent it from tilting. When the sheet retaining member is less than the distance between the corners of the spacer frame, it is recommended that an adhesive be used to secure the sheet retaining member in position while the intermediate sheet is being mounted. The adhesive may be any of the types used in the art. Types that may be used include Fuller hot melt adhesive. As can be appreciated the invention is not limited to the dimensions of the sheet retaining member or the number of sheet retaining members and the number of sheet retaining members and the size of the sheet retaining member should be sufficient to maintain the intermediate sheet in position between the other sheets.

After the retainer member 31 is mounted in the spacer stock, the bead 83 of H. B. Fuller HL 5102X-125 butyl hot melt matrix having the desiccant 84 may be provided on the inner surface of the base of the spacer frame as shown in FIGS. 9 and 10 and/or on the surface of the sheet retaining member as shown in FIG. 3. As can be appreciated the bead 83 may be provided on the spacer frame, and thereafter the sheet retaining member mounted within the outer layer of the spacer and held in position by the bead.

The spacer stock is mounted around the intermediate sheet 29 as follows. The peripheral and marginal edge portion of intermediate sheet 29 are positioned through the bead 83 into the recess 62 of the sheet retaining member between notches 114 and 116. The spacer stock between the pair of notches 116 and 118 is bent to position the recess 62 of the s sheet retaining member 60 about the peripheral and marginal edge portions of the intermediate sheet; the spacer section between the pair of notches 118 and the end 106 is bent to position the peripheral and marginal edge portions of the intermediate sheet in the recess 62 of the sheet retaining member 60 between the notches 118 and the end 106. The tapered end 102 is bent to a 90° angle at the notches 112, and the spacer stock is bent to position the recess 62 of the sheet retaining member 60 between the pair of notches 112 and the pair of notches 114 about the peripheral and marginal edge portions of the intermediate sheet. The end 102 is telescoped into the end 106 of the spacer stock to form the closed spacer frame. As can be appreciated, the sheet retaining member has to be positioned relative to the end 106 to receive the end 102 and secure the ends 102 and 106 together.

The holes 104 are aligned with the holes 108 after the spacer stock is positioned about the intermediate sheet to provide a spacer frame about the intermediate sheet. In the practice of the invention, it is recommended that a close end rivet be used to secure the ends of the spacer frame together.

The adhesive-sealant layers 28 are extruded onto the outer surface 42 of the outer legs 36 and 38. The adhesive-sealant of the layer 28 may be of the type sold by H. B. Fuller as H. B. Fuller 1191 hot melt butyl. The layer 28 has a thickness of about 0.020 inches (0.05 cm) and a height of about 0.300 inch (0.76 cm).

As can be appreciated, the bead 83 having the desiccant may be extruded before, after, or during the extrusion of the layers 28 and the layer 44 may be applied during or after the strip is formed into spacer stock.

The outer glass sheets 24 and 26 are thereafter positioned over the sealant-adhesive layer 28 and biased toward one another to flow the sealant-adhesive layer 28 to secure the outer glass sheets to the spacer frame. Thereafter the sealant-adhesive 44 is flowed into the channel formed by the marginal edge portions of the sheets and the base 40 of the spacer frame.

Figure 11:
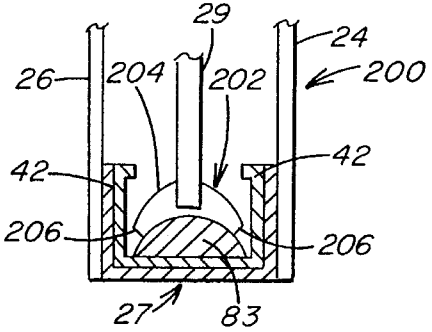
FIG. 11 is a view similar to the view of FIG. 2 illustrating another embodiment of the sheet retaining member of the instant invention.

With reference to FIG. 11, there is shown multi-sheet 200 having sheet retaining member 202 to secure the intermediate sheet 29 in position between outer sheets 24 and 26. The sheet retaining member has a recess 204 sized to provide a pressure fit when mounted on the peripheral and marginal edge portions of the sheet 29. The sheet retaining member has sloped ends 206 to facilitate urging the sheet retaining member 202 between outer legs 42 of the spacer frame 27. The unit 200 may be made similar to the unit discussed above except that after the U-shaped spacer stock is formed and the bead 83 applied, an intermediate sheet having the sheet retaining members 202 on the peripheral and marginal edges of the intermediate sheet is urged between the outer legs of the spacer stock to position the intermediate sheet. Thereafter the spacer stock is mounted around the intermediate sheet by urging the outer legs against the sheet retaining member 202 on the peripheral and marginal edges of the sheet 26.

As can now be appreciated the invention is not limited to the embodiment of the glazing unit discussed above, and additional embodiments can be generated within the scope of the invention.

What is claimed is:

1. A multi-sheet glazing unit comprising:

a spacer frame having a base, a first upright leg connected to the base and a second upright leg connected to the base and spaced from the first upright leg, the first and second upright legs and the base having a generally U-shaped configuration, the base having a first surface and a second surface opposite to the first surface with the second surface facing interior of the spacer frame, the first and second upright legs each having a surface facing away from the interior of the spacer frame defined as an outer surface;

a pair of outer sheets, one of the outer sheets secured to the outer surface of the first upright leg and the other one of the outer sheets secured to the outer surface of the second upright leg;

a sheet retaining member having a first surface and a second surface opposite to the first surface, the first surface having edge retaining means, the sheet retaining member being between the upright legs of the spacer frame with the second surface of the sheet retaining member facing the second surface of the base, and a third sheet having marginal and peripheral edges wherein the edge retaining means of the sheet retaining member engages portions of the marginal and peripheral edges of the third sheet to position the third sheet within the spacer frame spaced from the outer sheets.

2. The unit of claim 1 wherein the edge retaining means is a recess in the first surface to receive portions of the marginal and peripheral edges of the third sheet.

3. The unit of claim 2 wherein the recess is a continuous groove.

4. The unit of claim 2 wherein the sheet retaining member includes an elongated substrate having opposed edges and opposed ends and the recess is formed by a pair of raised portions spaced from one another and extending between the edges of the elongated substrate.

5. The unit of claim 2 wherein the third sheet is one of a plurality of intermediate sheets between the outer sheets, the sheet retaining member includes a substrate having the first and second surfaces of the sheet retaining means and the recess is one of a plurality of recesses in the first surface of the substrate with one recess for portion of marginal and peripheral edges of one of the intermediate sheets.

6. The unit of claim 2 wherein the sheet retaining member includes a substrate having a pair of upright members joined to the substrate to provide the sheet retaining member with a generally U-shaped cross section with the first surface of the sheet retaining member between the upright members.

7. The unit of claim 2 wherein the spacer frame is a closed spacer frame and has a first corner, a second corner, a third corner and a fourth corner with the first corner between the second and fourth corners, the second corner between the first and third corners, the third corner between the second and fourth corners and the fourth corner between the first and third corners.

8. The unit of claim 7 wherein the outer sheets are secured to the upright legs of the spacer frame by a moisture impervious sealant securing marginal edge portions of the outer sheets to the outer surface of adjacent upright leg of the spacer frame and further including a space between adjacent sheets define as a compartment and the compartments are filled with an inert gas.

9. The unit of claim 7 wherein the unit has at least one sheet retaining member between each of the first and second corners, the second and third corners, the third and fourth corners, and the fourth and first corners.

10. The unit of claim 7 wherein the unit has at least two sheet retaining members between each of the first and second corners, the second and third corners, the third and fourth corners, and the fourth and first corners.

11. The unit of claim 1 wherein the sheet retaining member has opposed edges and opposed ends with the opposed ends generally transverse to a plane having one of the upright legs and a recess is formed by a plurality of discreet spaced raised portions extending along a first predetermined path between the ends of the sheet retaining member and a plurality of discreet spaced raised portions along a second predetermined path between the ends of the shoe retaining member, wherein the first predetermined path is spaced from the second predetermined path to define the recess therebetween.

12. The unit as set forth in claim 11 wherein the first and second predetermined paths are linear paths.

13. The unit of claim 1 wherein peripheral dimensions of the spacer frame are less than peripheral dimensions of the outer sheets to provide the unit with a peripheral channel between the outer sheets, wherein the peripheral channel is filled with a moisture impervious sealant.

14. The multiple glazed unit of claim 1 wherein the sheets are glass sheets.

15. The unit of claim 14 wherein the unit has continuous corners and a low thermal conducting edge.

16. The multiple glazed unit of claim 1 further including a layer of a moisture pervious adhesive having a desiccant therein on selective portions of the second surface of the base of the spacer frame or on selective portions of the first surface of the sheet retaining member.

17. The unit as set forth in claim 1 wherein movement between, and toward and away from the upright legs is defined as lateral movement and the lateral movement of the edge retaining member is limited by the upright legs of the spacer frame.

18. The unit of claim 17 wherein the sheet retaining member is secured to the second surface of the base of the spacer frame.

19. The unit as set forth in claim 1 wherein the edge retaining member is made of metal.

20. The unit as set forth in claim 1 wherein the edge retaining member is made of a non-metallic material.

21. A method of making a multi-sheet glazed unit comprising the steps of:

providing a section of spacer stock, the spacer stock having a pair of upright legs connected to a base, the upright legs and base having a generally U-shaped cross section;

providing a sheet retaining member having a first surface and a second surface opposite to the first surface; the first surface having a recess;

positioning marginal and peripheral edge portions of a sheet in the recess;

positioning the spacer stock around the sheet and sheet retaining member to provide a spacer frame having the sheet and sheet retaining member within the spacer frame; and securing an outer sheet to each of the upright legs to provide the multi-sheet glazed unit.

22. The method as set forth in claim 21 wherein a space is between adjacent sheets defined as a compartment and further including the step of providing a layer of a moisture pervious adhesive having a desiccant therein in communication with each of the compartments.

23. The method of claim 21 wherein said step of providing a spacer stock includes the step of providing a spacer stock of sufficient length to make a spacer frame having peripheral dimensions equal to or less than the peripheral dimensions of the outer sheets, the spacer stock having a U-shaped cross section with crease lines and notches in the upright legs of the spacer stock at expected corners of the spacer frame, wherein prior to practicing the step of positioning marginal and peripheral edge portions of a sheet in the recess, positioning the sheet retaining member between the upright legs of the spacer stock.

24. The method of claim 21 further including the step of securing the sheet retaining member between the upright legs of the spacer stock.

25. The method as set forth in claim 21 wherein said step of positioning marginal and peripheral edge portions of a sheet in the recess includes the step of;

providing an intermediate sheet having sheet retaining members on selected portions of the peripheral and marginal edges of the intermediate sheet; and said step of positioning the spacer stock includes the step of moving the sheet retaining members and spacer stock relative to one another to position the sheet retaining member between outer legs of the spacer stock.

26. The method of claim 25 wherein the step of providing a section of spacer stock includes the step of providing a bead of moisture pervious adhesive having a desiccant therein on inner surface of the base of the spacer stock.

27. The method of claim 26 wherein the intermediate sheet has four sides and the spacer stock is divided into four portions, each portion corresponding to a side of the intermediate sheet, and said moving the sheet step includes moving one side of the intermediate sheet having the edge retaining member on its peripheral and marginal edge into a portion of the spacer stock, and thereafter sequentially urging the remaining portions of spacer stock against the sheet retaining members on the remaining sides of the intermediate sheet to provide a spacer frame about the intermediate sheet.

* * * * *

UNITED STATES PATENT AND TRADEMARK OFFICE

CERTIFICATE OF CORRECTION

PATENT NO. : 5,553,440

DATED : September 10, 1996

INVENTOR(S) : Mark L. Bulger and Albert E. Thompson, Jr.

It is certified that error appears in the above-indentified patent and that said Letters Patent is hereby corrected as shown below:

Column 11, line 34,

Claim 11, line 9, delete "shoe" and insert --sheet--.

Signed and Sealed this

Fourth Day of February, 1997

*Attest:*

*Attesting Officer*

BRUCE LEHMAN

*Commissioner of Patents and Trademarks*